US012280415B2

(12) United States Patent
Sandberg et al.

(10) Patent No.: US 12,280,415 B2
(45) **Date of Patent: *Apr. 22, 2025**

(54) COLD WORKING APPARATUS AND A METHOD FOR COLD WORKING A BLANK

(71) Applicant: Autotech Engineering S.L., Bizkaia (ES)

(72) Inventors: Lars Sandberg, Luleå (SE); Joakim Innala, Luleå (SE); Petter Ulfberg, Luleå (SE)

(73) Assignee: Autotech Engineering S.L., Bizkaia (ES)

( * ) Notice: Subject to any disclaimer, the term of this patent is extended or adjusted under 35 U.S.C. 154(b) by 300 days.

This patent is subject to a terminal disclaimer.

(21) Appl. No.: 17/607,157

(22) PCT Filed: Apr. 17, 2020

(86) PCT No.: PCT/SE2020/050395
§ 371 (c)(1),
(2) Date: Oct. 28, 2021

(87) PCT Pub. No.: WO2020/222687
PCT Pub. Date: Nov. 5, 2020

(65) Prior Publication Data

US 2022/0203427 A1 Jun. 30, 2022

(30) Foreign Application Priority Data

Apr. 29, 2019 (SE) ..... 1950512-2

(51) Int. Cl.
*B21D 22/20* (2006.01)
*B21D 22/02* (2006.01)
*B21D 37/01* (2006.01)

(52) U.S. Cl.
CPC ..... *B21D 22/20* (2013.01); *B21D 22/02* (2013.01); *B21D 37/01* (2013.01)

(58) Field of Classification Search
CPC ..... B21D 22/02; B21D 22/06; B21D 22/20; B21D 37/01; B21D 37/18; B30B 15/02
See application file for complete search history.

(56) References Cited

U.S. PATENT DOCUMENTS

| | | | | |
|---|---|---|---|---|
| 3,064,511 | A | 11/1962 | Allander | |
| 3,592,651 | A | 7/1971 | Klemm et al. | |
| 4,195,510 | A | 4/1980 | Juergens | |
| 6,553,806 | B1 * | 4/2003 | Reinert | B21D 22/28 72/349 |
| 10,576,524 | B1 | 3/2020 | Yuan | |
| 2001/0049953 | A1 | 12/2001 | Nagasawa | |

(Continued)

FOREIGN PATENT DOCUMENTS

| | | | |
|---|---|---|---|
| CN | 106944545 A | * | 7/2017 |
| CN | 109325262 A | | 2/2019 |

(Continued)

*Primary Examiner* — Christopher L Templeton
*Assistant Examiner* — P Derek Pressley
(74) *Attorney, Agent, or Firm* — Blank Rome LLP

(57) ABSTRACT

A cold working apparatus for forming a blank includes a first die and a second die. The first die has at least one die cavity and the second die has at least one die protrusion. The cold working apparatus press forms the blank placed between the first and second dies.

10 Claims, 3 Drawing Sheets

(56) References Cited

U.S. PATENT DOCUMENTS

| | | | | |
|---|---|---|---|---|
| 2002/0186007 | A1* | 12/2002 | Cao | B82Y 30/00 324/207.16 |
| 2010/0018277 | A1 | 1/2010 | Hielscher | |
| 2016/0082496 | A1 | 3/2016 | Kim et al. | |
| 2018/0236522 | A1 | 8/2018 | Yamamoto | |
| 2018/0318909 | A1 | 11/2018 | Morales et al. | |

FOREIGN PATENT DOCUMENTS

| | | | | | |
|---|---|---|---|---|---|
| DE | 199 44 722 | A1 | | 4/2001 | |
| DE | 10 2011 055 643 | A1 | | 5/2013 | |
| DE | 102012014201 | B3 | * | 8/2013 | B21D 22/22 |
| DE | 11 2016 003 905 | T5 | | 5/2018 | |
| EP | 1623824 | A1 | | 2/2006 | |
| EP | 2 711 101 | A1 | | 3/2014 | |
| EP | 3 144 078 | A1 | | 3/2017 | |
| JP | H-0671357 | A | * | 7/1992 | |
| JP | H05-65231 | B | | 9/1993 | |
| JP | H6-71357 | A | | 3/1994 | |
| JP | H-06116745 | A | * | 4/1994 | |
| JP | H09-253770 | A | | 9/1997 | |
| JP | H10-296336 | A | | 11/1998 | |
| JP | 2003-010928 | A | | 1/2003 | |
| JP | 2005-193293 | A | | 7/2005 | |
| JP | 2005-288533 | A | | 10/2005 | |
| JP | 2009-082976 | A | | 4/2009 | |
| JP | 2011-189357 | A | | 9/2011 | |
| JP | 2013-176803 | A | | 9/2013 | |
| JP | 2016-122047 | A | | 7/2016 | |
| KR | 10-2012-0110552 | | * | 10/2012 | |
| RU | 178 662 | U1 | | 4/2018 | |
| WO | WO 2012/101826 | A1 | | 8/2012 | |

* cited by examiner

COLD WORKING APPARATUS AND A METHOD FOR COLD WORKING A BLANK

TECHNICAL FIELD

Aspects of the present invention relate to a cold working apparatus for forming a blank, wherein the cold working apparatus comprises a first die and a second die. The first die has at least one die cavity, and the second die has at least one die protrusion, the die protrusion of the second die being complementary to the die cavity of the first die. The cold working apparatus is configured to, by means of the first and second dies, press form the blank placed between the first and second dies. Further, aspects of the present invention relate to a method for cold working a blank.

BACKGROUND

Pressed metal parts, from a cold working process, for example parts of aluminium, are often used in the car industry for various parts of the car, e.g. thresholds, bumpers, support elements and structures etc. Other fields of application are also possible. When press forming a blank between two dies to form a metal part, blank material may remain on the press forming surface of a die after press forming. This may be called "cladding" and impairs the process of press forming metal parts and impairs the quality of the resulting metal parts.

SUMMARY

An object of embodiments of the invention is to provide a solution which mitigates or solves the drawbacks and problems of conventional solutions.

According to a first aspect of the invention, the above-mentioned and other objects of the embodiments of the present invention are attained by providing a cold working apparatus for forming a blank, wherein the cold working apparatus comprises a first die and a second die. The first die has at least one die cavity, and the second die has at least one die protrusion. The die protrusion of the second die being complementary to the die cavity of the first die. The cold working apparatus is configured to, by means of the first and second dies, press form the blank placed between the first and second dies. At least one of the first and second dies has a draw radius. A member is attached to a die which has a draw radius, at least a portion of the member being positioned adjacent to or on the draw radius. The member defines a first press forming surface, and the die holding the member defines a second press forming surface outside the first press forming surface. The member and the die, which holds the member, are configured such that during the same press forming, a first friction arises between the blank and the first press forming surface when the blank is in contact with the member and a second friction arises between the blank and the second press forming surface when the blank is in contact with the die holding the member. The first friction is lower than the second friction. Since the member is attached to a die of the apparatus, the apparatus comprises the member.

An advantage of the apparatus according to the first aspect is that an increased or improved deformability, or suitability for forming, is provided. The reason, which has been identified by the inventor, is that a higher force is required to pull the blank material over the draw radius when the friction is high adjacent to or on the draw radius, which results in an increased strain or elongation of the blank material and an increased risk of fractures in or breaking of the resulting metal part. The inventor has found that a reduction of the friction adjacent to or on the draw radius by means of the innovative member and the innovative position of the member means that less force is required to pull the blank material over the draw radius and an excessive strain or elongation of the blank material is thus avoided. The result is an improved quality of the resulting metal parts.

A further advantage of the apparatus according to the first aspect is reduced cladding on the die, whereby inter alia the wear on the dies is reduced and the amount of required maintenance is reduced. Since the cladding is reduced, also the overall friction is more stable which results in improved tolerances of the resulting metal parts. When cladding occurs, the friction experienced by the blank is changed, for example increased. When this happens, the force required to form the resulting part from the blank is increased, which in turn increases the risk of fractures in and breaking of the resulting metal part. The result is also an excessive strain or elongation of the blank material, which negatively affects the tolerances of the resulting metal parts, since the movement of the blank during press forming is not identical between the different pressings. Further, an advantage of the apparatus according to the first aspect is that an improved surface quality is attained. When cladding occurs, the result is often that scratches are produced from the pulling of the blank when cold working, which is a problem especially for resulting metal parts which are to be visible when mounted.

Another advantage of the apparatus according to the first aspect is that less lubricant is required, which results in reduced costs and less pollution from the cold working to the environment, which in turn provides for a cold working process which has less negative impact on the environment.

The inventor has found that the above-mentioned problems solved by the apparatus according to the first aspect are most prominent adjacent to or on the draw radius, because the biggest lateral displacement of the blank takes place adjacent to or on the draw radius.

According to an advantageous embodiment of the cold working apparatus according to the first aspect, at least a portion of the member is positioned, or located, on the draw radius. Positive technical effects associated with this embodiment are mentioned above.

According to an advantageous embodiment of the cold working apparatus according to the first aspect, at least a portion of the member surrounds the die cavity or the die protrusion. An advantage of this embodiment is that cladding on the die is further reduced, and the positive technical effects mentioned above are further enhanced.

According to a further advantageous embodiment of the cold working apparatus according to the first aspect, at least a portion of the member is positioned outside the die cavity or the die protrusion. An advantage of this embodiment is that cladding on the die is further reduced, and the positive technical effects mentioned above are further enhanced.

According to another advantageous embodiment of the cold working apparatus according to the first aspect, the member is provided as a coating applied to a die that has a draw radius. An advantage of this embodiment is that the member is attached to the die in an efficient manner, whereby the positive technical effects mentioned above are further enhanced.

According to still another advantageous embodiment of the cold working apparatus according to the first aspect, the member is provided as a liquid applied to a die, which has a draw radius, and is subsequently cured. An advantage of this embodiment is that the member is attached to the die in an efficient manner, whereby the positive technical effects mentioned above are further enhanced.

According to yet another advantageous embodiment of the cold working apparatus according to the first aspect, the member comprises an adhesive tape having a first surface and a second surface, wherein the first surface of the adhesive tape forms the first form pressing surface of the member, and the second surface of the adhesive tape is provided with at least one adhesive substance, and wherein the second surface of the adhesive tape is attached to a die, which has a draw radius, by means of the at least one adhesive substance. An advantage of this embodiment is that the member is attached to the die in an efficient and uncomplicated manner, whereby the positive technical effects mentioned above are further enhanced.

According to an advantageous embodiment of the cold working apparatus according to the first aspect, a die, which has a draw radius, is provided with at least one recess holding the member. An advantage of this embodiment is that the member is attached to the die in an efficient manner, whereby the positive technical effects mentioned above are further enhanced.

According to a further advantageous embodiment of the cold working apparatus according to the first aspect, the member is resilient. An advantage of this embodiment is that the displacement of the blank, for example the lateral displacement of the blank, during cold working is further improved. An advantage of this embodiment is also that the positive technical effects mentioned above are further enhanced.

According to another advantageous embodiment of the cold working apparatus according to the first aspect, the first die has a draw radius, and the member is attached to the first die. The inventor has identified that the problems mentioned above in relation to the draw radius are especially prominent with regard to the die cavity. An advantage of this embodiment is that the lateral displacement of the blank during cold working is further improved. An advantage of this embodiment is also that the positive technical effects mentioned above are further enhanced.

According to yet another advantageous embodiment of the cold working apparatus according to the first aspect, the member is a polymer member. An advantage of this embodiment is that the lateral displacement of the blank during cold working is further improved. An advantage of this embodiment is also that the positive technical effects mentioned above are further enhanced.

According to still another advantageous embodiment of the cold working apparatus according to the first aspect, the polymer member is made of an elastomer or a mixture of elastomers. An advantage of this embodiment is that the lateral displacement of the blank during cold working is further improved. An advantage of this embodiment is also that the positive technical effects mentioned above are further enhanced.

According to an advantageous embodiment of the cold working apparatus according to the first aspect, the polymer member is at least partly made of polyimide. An advantage of this embodiment is that the displacement of the blank during cold working is further improved. An advantage of this embodiment is also that the positive technical effects mentioned above are further enhanced.

According to a further advantageous embodiment of the cold working apparatus according to the first aspect, one of the first and second dies is an upper die placed above the other die, which is a lower die, wherein at least one of the first and second dies is essentially vertically movable in relation to the other die, and wherein the essentially vertically movable die is configured to move essentially vertically towards the other die for press forming the blank. An advantage of this embodiment is that the positive technical effects mentioned above are further enhanced.

According to a second aspect of the invention, the above-mentioned and other objects of the embodiments of the present invention are attained by providing a method for cold working a blank, the method comprising the steps of:

Placing the blank between a first die and a second die, wherein the first die has at least one die cavity, and the second die has at least one die protrusion, the die protrusion of the second die being complementary to the die cavity of the first die, wherein at least one of the first and second dies has a draw radius, wherein a member is attached to a die that has a draw radius, at least a portion of the member being positioned adjacent to or on the draw radius, wherein the member defines a first press forming surface, and the die holding the member defines a second press forming surface outside the first press forming surface; and Press forming the blank placed between the first and second dies by means of the first and second dies, wherein during the same press forming, a first friction arises between the blank and the first press forming surface when the blank is in contact with the member and a second friction arises between the blank and the second press forming surface when the blank is in contact with the die that holds the member, the first friction being lower than the second friction.

Advantages of the method according of the second aspect of the present invention correspond to advantages mentioned above in connection with the cold working apparatus according to the first aspect.

According to an advantageous embodiment of the method according to the second aspect, one of the first and second dies is an upper die placed above the other die, which is a lower die, and the method is characterized by essentially vertically moving at least one of the first and second dies towards the other die for press forming the blank. An advantage of this embodiment is that the positive technical effects mentioned above are further enhanced.

The above-mentioned features and embodiments of the cold working apparatus and the method, respectively, may be combined in various possible ways providing further advantageous embodiments.

Further advantageous embodiments of the cold working apparatus and method according to the present invention and further advantages with the embodiments of the present invention emerge from the dependent claims and the detailed description of embodiments.

BRIEF DESCRIPTION OF THE DRAWINGS

Aspects of the present invention will now be described, for exemplary purposes, in more detail by way of embodiments and with reference to the enclosed drawings, in which.

DETAILED DESCRIPTION

Figure 1:
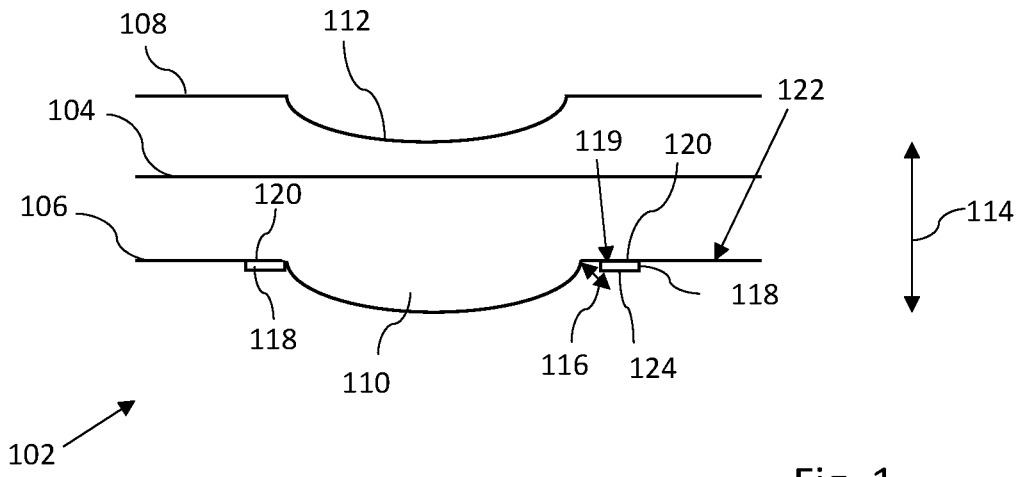
FIG. 1 is a schematic side view of first embodiments of the cold working apparatus according to the first aspect.
Figure 2:
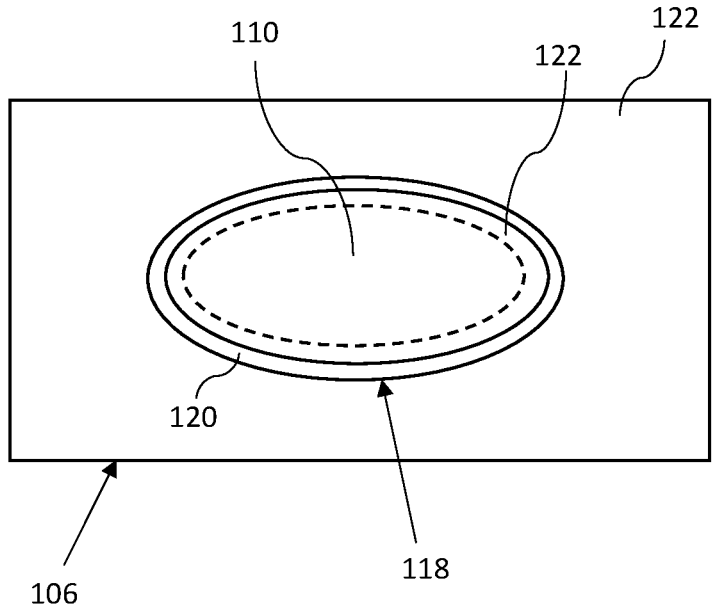
FIG. 2 is a schematic top view of the first die of the apparatus of FIG. 1.

With reference to FIGS. 1 and 2, a cold working apparatus 102 for forming a blank 104 is provided. The blank 104 may comprise or consist of a metal or a metal alloy. The blank 104 may comprise or consist of aluminium or a metal alloy including aluminium. The blank 104 may be a sheet of a material, for example a sheet comprising or consisting of a metal or a metal alloy. The cold working apparatus 102 includes a first die 106 and a second die 108. The first die 106 has at least one die cavity 110, which is surrounded by the remainder of the first die 106. The second die 108 has at least one die protrusion 112. The die protrusion 112 of the second die 108 is complementary to the die cavity 110 of the first die 106. The first die 106 may be called a female die, and the second die 108 can be called a male die. Each of the first and second dies 106, 108 may comprise or consist of a metal or a metal alloy. In the embodiment shown in FIGS. 1 and 2, one of the first and second dies 106, 108 is an upper die 108 placed above the other die 106, which is a lower die 106. At least one of the first and second dies 106, 108 is essentially vertically movable in an essentially vertical direction 114 in relation to the other die 106, 108. The essentially vertically movable die 106, 108 is configured to move essentially vertically towards the other die 106, 108 for press forming the blank 104. The first die 106 can be a lower die 106, or an upper die, in relation to the second die 108. The second die 108 can be an upper die 108, or a lower die, in relation to the first die 106. In the embodiment shown in FIGS. 1 and 2, the first die 106 is a lower die 106, and the second die 108 is an upper die 108. However, other positions of the first and second dies 106, 108 are possible.

With reference to FIGS. 1 and 2, the cold working apparatus 102 is configured to, by means of the first and second dies 106, 108, press form the blank 104 placed between the first and second dies 106, 108. At least one of the first and second dies 106, 108 has a draw radius 116, or defines or presents a draw radius 116. In the embodiment shown in FIGS. 1 and 2, at least the first die 106 has a draw radius 116. The draw radius 116 may be adjacent to the die cavity 110 of the first die 106. When the second die 108, i.e. the male die, has a draw radius, the draw radius may be adjacent to the die protrusion 112 of the second die 108.

The apparatus 102 includes a member 118 attached to a die 106 which has a draw radius 116. The apparatus 102 could include a plurality of members 118 attached to a die 106. Thus, in the embodiment shown in FIGS. 1 and 2, the member 118 is attached to the first die 106. At least a portion 119 of the member 118 is positioned adjacent to or on the draw radius 116. The member 118 defines a first press forming surface 120. The die 106 holding the member 118, in the present case the first die 106, defines a second press forming surface 122 outside the first press forming surface 120. The area of the first press forming surface 120 may be less than 25% of the area of the second press forming surface 122, for example less than 10% of the area of the second press forming surface 122.

The member 118 and the die 106, which holds the member 118, are configured such that during the same press forming, a first friction arises, or is present, between the blank 104 and the first press forming surface 120 when the blank 104 is in contact with, and possibly moves in relation to, the member 118 and a second friction arises between the blank 104 and the second press forming surface 122 when the blank 104 is in contact with, and possibly moves in relation to, the die 106 which holds the member 118. As mentioned above, in the embodiment shown in FIGS. 1 and 2, the first die 106 holds the member 118. The first friction, i.e. the friction between the blank 104 and the first press forming surface 120, is lower than the second friction, i.e. the friction between the blank 104 and the second press forming surface 122.

Friction is the force resisting the relative motion of solid surfaces, fluid layers, and material elements sliding against each other. Dry friction is a force that opposes the relative lateral motion of two solid surfaces in contact, i.e. the blank 104 and the first press forming surface 120, or the blank 104 and the second press forming surface 122 with regard to the solution described in this disclosure. Dry friction may be subdivided into static friction ("stiction") between non-moving surfaces, and kinetic friction between moving surfaces. Said first friction is reduced in relation to said second friction, i.e. the first friction is lower than the second friction. The coefficient of friction, COF, of the first press forming surface 120 is lower than the COF of the second press forming surface 122, which is valid for both static friction and kinetic/sliding friction. The first friction may be at least 10% lower, for example at least 30% lower, or at least 50% lower, than the second friction. For example, the COF of the first press forming surface 120 may be at least 10% lower, for example at least 30% lower, or at least 50% lower, than the COF of the second press forming surface 122. The member 130 may be called a friction-reducing member 130.

The member 118 is advantageously elongated. The material of the member 118, or the material of the first press forming surface 120, may be different from the material of the die 106 holding the member 118, or different from the material of the second press forming surface 122. Each of the first and second press forming surfaces 120, 122 may be provided with a structure or a pattern. The structure or pattern may include grooves and/or bars. The structure or pattern of the first press forming surface 120 may be different from the structure or pattern of the second press forming surface 122. The member 118 may be adjacent to die cavity 110 of the first die 106. If the second die 108 were holding a member, the member may be adjacent to the die protrusion 112. Both the first and second dies 106, 108 could hold its own member 118 or members 118. The member 118 may be a polymer member 118. The polymer member 118 may be made of an elastomer or a mixture of elastomers. Advantageously, the polymer member 118 is at least partly made of polyimide. The entire member 118 may be made of polyimide.

With reference to FIG. 2, at least a portion of the member 118 or the entire member 118 surrounds the die cavity 110 of the first die 106. If the second die 108 were holding a member 188, the member 118 could surround the die protrusion 112 of the second die 108. At least a portion of the member 118 is positioned outside the die cavity 110 of the first die 106. If the second die 108 were holding a member 188, at least a portion of the member 118 could be positioned outside the die protrusion 112 of the second die 108.

With reference to the first embodiments of FIGS. 1 and 2, the member 118 may be provided as a coating applied to the die 106 that has a draw radius 116, for example to the first die 106. Alternatively, the member 118 may be provided as a liquid applied to the die 106 that has a draw radius 116 and may subsequently be cured. Alternatively, the member 118 may comprise an adhesive tape having a first surface 120 and a second surface 124. The first surface 120 of the adhesive tape forms the first form pressing surface 120 of the member 118, and the second surface 124 of the tape is provided with at least one adhesive substance. The second surface 124 of the tape is attached to the die 106, which has a draw radius 116, i.e. the first die 106 in the embodiment shown in FIGS. 1 and 2, by means of the at least one adhesive substance.

Figure 3:
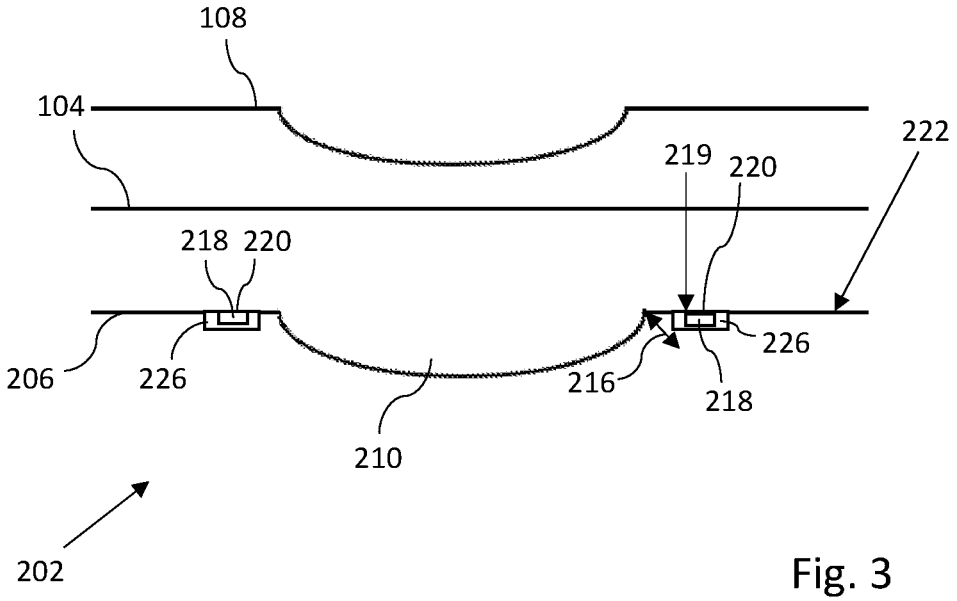
FIG. 3 is a schematic side view of a second embodiment of the cold working apparatus according to the first aspect.
Figure 4:
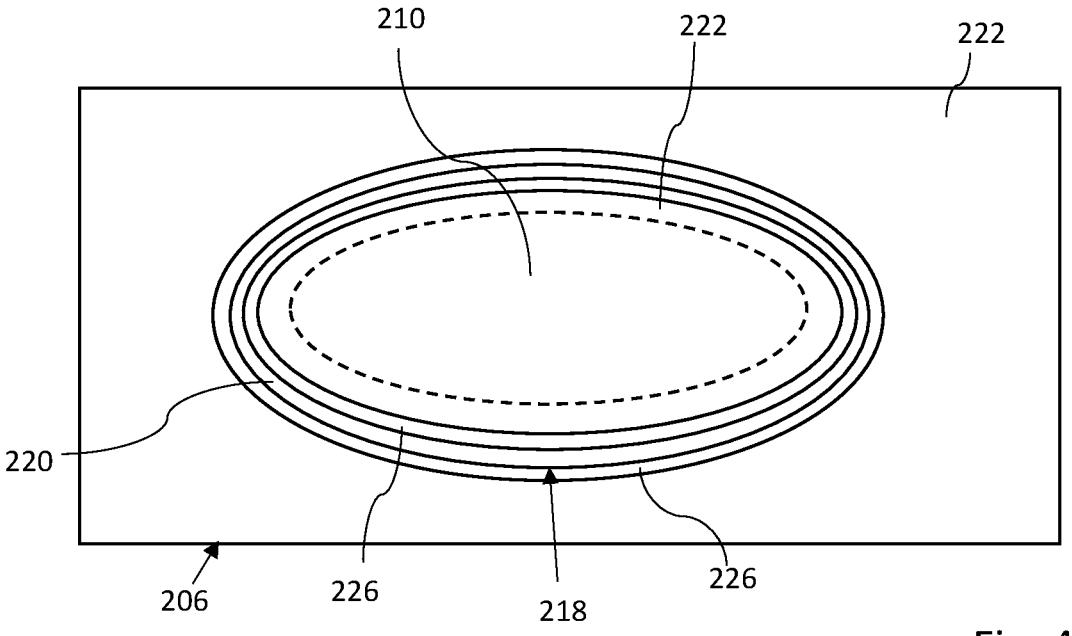
FIG. 4 is a schematic top view of the first die of the apparatus of FIG. 3.

With reference to FIGS. 3 and 4, a second embodiment of the apparatus 202 is illustrated. In most parts, the apparatus 202 of the second embodiment of FIGS. 3 and 4 corresponds to the apparatus 102 of the first embodiments of FIGS. 1 and 2. The difference is that the die 206, for example the first die 206 with the die cavity 210, which has a draw radius 216, is provided with at least one recess 226 or groove holding the member 218. At least a portion 219 of the member 218 is positioned adjacent to or on the draw radius 216. The member 218 may essentially correspond to the member 118 of FIGS. 1 and 2. For example, the member 218 also defines a first press forming surface 220. However, the member 218 of FIGS. 3 and 4 is resilient or flexible, such that before cold working the first press forming surface 220 of the member 218 is slightly elevated above the second press forming surface 222 of the first die 206, the second press forming surface 222 being outside the first press forming surface 220. When the blank 104 is pressed by the first and second dies 206, 108 the resilient member 218 is compressed and the first press forming surface 220 of the member 218 is thus moved towards the same level as the second press forming surface 222 of the first die 206. Otherwise, the features of the apparatus 202 of the second embodiment of FIGS. 3 and 4 correspond to the features of the apparatus 102 of first embodiments of FIGS. 1 and 2 and are thus not repeated here. For example, the second die 108 of the apparatus 202 of the second embodiment of FIGS. 3 and 4 corresponds to the second die 108 of the apparatus of the first embodiments of FIGS. 1 and 2.

Figure 5:
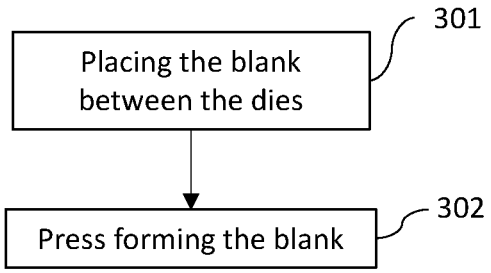
FIG. 5 is a flow chart illustrating embodiments of the method according to the second aspect of the present invention.

With reference to FIG. 5, a flow chart illustrates embodiments of the method for cold working a blank 104 according to the second aspect of the present invention. The method includes the steps of:

Placing 301 the blank 104 between a first die 106 and a second die 108, wherein the first die 106 has at least one die cavity 110, and the second die 108 has at least one die protrusion 112, the die protrusion 112 of the second die 108 being complementary to the die cavity 110 of the first die 106, wherein at least one of the first and second dies 106, 108 has a draw radius 116, wherein a member 118 is attached to a die 106 that has a draw radius 116, at least a portion 119 of the member 118 being positioned adjacent to or on the draw radius 116, wherein the member 118 defines a first press forming surface 120, and the die 106 holding the member 118 defines a second press forming surface 122 outside the first press forming surface 120; and Press forming 302 the blank 104 placed between the first and second dies 106, 108 by means of the first and second dies 106, 108, wherein during the same press forming, a first friction arises between the blank 104 and the first press forming surface 120 when the blank 104 is in contact with, and possibly moved in relation to, the member 118 and a second friction arises between the blank 104 and the second press forming surface 122 when the blank 104 is in contact with, and possibly moved in relation to, the die 106 that holds the member 118, the first friction being lower than the second friction.

The step of press forming 302 may include, when one of the first and second dies 106, 108 is an upper die 108 placed above the other die 106, which is a lower die 106, essentially vertically moving at least one 106, 108 of the first and second dies 106, 108 towards the other die 106, 108 for press forming the blank 104. The step of placing 301 the blank 104 between the first die 106 and the second die 108 may be performed by moving the blank 104 in relation the first and/or second die 106, 108, for example by lateral movement of the blank 104, or by moving the first and/or second die 104, 106 in relation to the blank 104, for example by lateral movement of the first and/or second die 104, 106.

The features of the different embodiments of the apparatus and method disclosed above may be combined in various possible ways providing further advantageous embodiments. The invention shall not be considered limited to the embodiments illustrated, but can be modified and altered in many ways by one skilled in the art, without departing from the scope of the appended claims.

The invention claimed is:

1. A cold working apparatus for forming a blank, the cold working apparatus comprising a first die and a second die, wherein the first die has at least one die cavity, and the second die has at least one die protrusion, the die protrusion of the second die being complementary to the die cavity of the first die, wherein the cold working apparatus is configured to, by means of the first and second dies, press form the blank placed between the first and second dies, wherein at least one of the first and second dies has a draw radius, wherein a member is attached to the die which has the draw radius, at least a portion of the member being positioned adjacent to or on the draw radius, wherein the member defines a first press forming surface, and the die holding the member defines a second press forming surface outside the first press forming surface, wherein the member consists of an adhesive tape having a first surface and a second surface, wherein the first surface of the adhesive tape forms the first press forming surface of the member, and the second surface of the adhesive tape is provided with at least one adhesive substance, and wherein the second surface of the adhesive tape is attached to the die by means of the at least one adhesive substance, wherein the member and the die, which holds the member, are configured such that during the same press forming, a first friction arises between the blank and the first press forming surface when the blank is in contact with the member and a second friction arises between the blank and the second press forming surface when the blank is in contact with the die which holds the member, the first friction being lower than the second friction.

2. A cold working apparatus according to claim 1, wherein at least a portion of the member is positioned on the draw radius.

3. A cold working apparatus according to claim 1, wherein at least a portion of the member surrounds the die cavity or the die protrusion.

4. A cold working apparatus according to claim 1, wherein at least a portion of the member is positioned outside the die cavity or the die protrusion.

5. A cold working apparatus according to claim 1, wherein a die, which has a draw radius, is provided with at least one recess holding the member.

6. A cold working apparatus according to claim 1, wherein the member is resilient.

7. A cold working apparatus according to claim 1, wherein the first die has a draw radius, and the member is attached to the first die.

8. A cold working apparatus according to claim 1, wherein one of the first and second dies is an upper die placed above the other die, which is a lower die, at least one of the first and second dies is essentially vertically movable in relation to the other die, and the essentially vertically movable die is configured to move essentially vertically towards the other die for press forming the blank.

9. A method for cold working a blank, the method comprising the steps of:

placing the blank between a first die and a second die, wherein the first die has at least one die cavity, and the second die has at least one die protrusion, the die protrusion of the second die being complementary to the die cavity of the first die, wherein at least one of the first and second dies has a draw radius, wherein a member is attached to the die that has the draw radius, at least a portion of the member being positioned adjacent to or on the draw radius, wherein the member defines a first press forming surface, and the die holding the member defines a second press forming surface outside the first press forming surface, and wherein the member consists of an adhesive tape having a first surface and a second surface, wherein the first surface of the adhesive tape forms the first press forming surface of the member, and the second surface of the adhesive tape is provided with at least one adhesive substance, and wherein the second surface of the adhesive tape is attached to the die by means of the at least one adhesive substance; and press forming the blank placed between the first and second dies by means of the first and second dies, wherein during the same press forming, a first friction arises between the blank and the first press forming surface when the blank is in contact with the member, and a second friction arises between the blank and the second press forming surface when the blank is in contact with the die that holds the member, the first friction being lower than the second friction.

10. A method for cold working a blank according to claim 9, wherein one of the first and second dies is an upper die placed above the other die, which is a lower die, and at least one of the first and second dies is essentially vertically moved towards the other die for press forming the blank.

* * * * *